US005120632A

United States Patent [19]

Bertrand et al.

[11] Patent Number: 5,120,632

[45] Date of Patent: Jun. 9, 1992

[54] PIGMENT PASSIVATION VIA POLYMER ENCAPSULATION

[75] Inventors: Jacques C. Bertrand, Ontario; Roger N. Ciccarelli, Rochester, both of N.Y.

[73] Assignee: Xerox Corporation, Stamford, Conn.

[21] Appl. No.: 635,658

[22] Filed: Dec. 28, 1990

[51] Int. Cl.[5] ..... G03G 9/08; G03G 9/14

[52] U.S. Cl. ..... 430/109; 430/138

[58] Field of Search ..... 430/109, 138

[56] References Cited

U.S. PATENT DOCUMENTS 4,719,164 1/1988 Podszun et al. ..... 430/115

4,761,358 8/1988 Hosoi et al. ..... 430/109

*Primary Examiner*—Marion E. McCamish

*Assistant Examiner*—S. Rosasco

*Attorney, Agent, or Firm*—Finnegan, Henderson, Farabow, Garrett & Dunner

[57] ABSTRACT

The range of differences in the triboelectric characteristics of various colored electrophotographic toners comprising pigments of different colors and having different triboelectric characteristics is narrowed by electrically passivating pigment particles with a continuous polymer coating on the surfaces of the pigment particles and dispersing the so-coated particles in a binder resin, which is subsequently pulverized to form toner particles.

9 Claims, No Drawings

PIGMENT PASSIVATION VIA POLYMER ENCAPSULATION

FIELD OF THE INVENTION

This invention relates to electrostatography and more it relates to electrophotographic toners for use in xerographic machines. Still more particularly this invention relates to the passivation of pigments of varying colors for use in formulating colored electrophotographic toners. Still more particularly this invention relates to such toners of varying colors having triboelectric charging properties which are within a narrow range.

BACKGROUND OF THE INVENTION

In electrostatography a uniform electrostatic charge is placed on a photoconductive insulating layer, selectively exposed to form a latent image thereon. The resulting latent electrostatic image is developed to provide a viable reproduction of an original by depositing on the latent image a finely divided xerographic marking material referred to in the art as "toner". Toner is normally attracted to those areas of the photoconductive layer which retain a charge, thereby forming a visible toner image corresponding to the electrostatic latent image. The image so produced may be transferred to a support surface or otherwise processed. The image may then be permanently affixed to the support by various conventional fixing methods, such as the application of heat or pressure or use of a solvent. In developing the latent image, the toner may be used alone or in combination with a suitable carrier, and additives, for example charge control agent, flow improvers or the like may be added to the toner.

The toner particles usually comprise a thermoplastic resin mixed with a pigment which is uniformly dispersed in the resin by heating and blending the toner ingredients in a suitable mill. After cooling, the blended mixture is then pulverized to form it into finely divided particles of the desired size range.

A xerographic machine is typically designed to operate with toners having specified triboelectric properties, and the machine has a very narrow triboelectric latitude within which it can operate. For example, if the xerographic machine is designed to operate with toner having a tribo of 15 microcoulombs/gram at a given relative humidity the machine will only operate with toners that have a range of about 13 to about 17 microcoulombs/grams.

When using colored pigments in toners, each type of pigment contributes to the triboelectric characteristics of the final toner. It has been the practice in preparing different color toners for use in a given copying machine to align the triboelectric properties of the toners by the use of charge control additives, so that the toners of different colors each have triboelectric characteristics within the operating range of the machine. Therefore, in order to provide a range of toners having different colors for use in a given copying machine it has been necessary to use different manufacturing techniques for each of the colored toners.

Heretofore, microencapsulation has been used for various purposes in the preparation of toners for electrostatography and in the surface treatment of other finely divided solids. Such purposes include thermal stability, chemical resistance, dispersibility, color retention, light fastness and the like. For example, U.S. Pat. No. 4,758,506 discloses a single component dry pressure fixable toner composition comprising a core mixture encapsulated with a polymeric shell by an interfacial polymerization process. U.S. Pat. No. 4,097,404 discloses a method of encapsulating toners comprising polymerization and coacervation resulting in a copolymer encapsulated in an incompatible shell polymer. Similarly, U.S. Pat. No. 4,626,490 discloses an encapsulated toner comprising a core material of a binder resin and magnetic particles encapsulated within a thin shell material. U.S. Pat. No. 4,803,144 also discloses an electrostatographic toner comprising a pressure fixable core material containing a colorant and magnetizable substance, and a pressure rupturable shell enclosing the core material.

U.S. Pat. No. 4,794,066 discloses a liquid electrostatic developer formed by coating organic pigments with a shell of a polymeric resin and flushing a water-wet pigment presscake of the coated pigment into a nonpolar liquid. U.S. Pat. No. 3,904,562 discloses encapsulating organic pigments in a vinyl pyrrolidine polymer and flushing an aqueous presscake of the encapsulated pigment into an oleoresinous organic phase.

U.S. Pat. Nos. 4,421,660 and 4,680,200 each disclose encapsulating pigments by use of an emulsion polymerization process, wherein the pigment particles are dispersed in a water insoluble monomer and emulsified to form very small monomer/pigment droplets, followed by polymerization of the monomer to encapsulate the pigment in the resulting polymer. The resulting encapsulated pigment particles are disclosed as being useful for a number of purposes, including toners.

Although it is known to encapsulate finely divided pigment particles with polymeric resins, in the normal electrographic toner manufacturing process, encapsulated pigments are dried and reground before being melt mixed in a toner binder resin. The resulting dispersion of pigment in the resin is then pulverized and classified to provide toner particles of the desired size.

We have now determined that if a polymer encapsulated pigment is ground prior to being blended into the binder resin of the toner, the polymer coating on the pigment particles becomes broken, so that the surfaces of the pigment particles are exposed. As a result, when such pigments are dispersed in binder resins and the dispersion formed into toners, each type of pigment exerts a different effect on the triboelectric characteristic of the final toner. This results in toners of different colors having a relatively wide range of triboelectric properties from one color toner to the next, which adversely affects their usefulness in electrostatographic copying machines.

We have now found that by encapsulating the pigment particles and maintaining the integrity of the polymer shell the particles can be passivated so that, regardless of the pigment used, toners can be made, without the use of charge control agents, which have triboelectric characteristics which fall within a narrow range as compared to the triboelectric characteristics of toners made when such encapsulation was not employed.

SUMMARY OF THE INVENTION

A primary object of the present invention is to provide electrophotographic toners having a narrow range of triboelectric characteristics, notwithstanding that the toners of different types contain electrically different pigments.

An additional object is to provide a simplified method for the production of different color toners having a narrow range of triboelectric properties.

Other objects of the present invention will become apparent from the following description and the practice of the invention.

The objects of the present invention are achieved by a particulate electrophotographic toner comprising discrete core particles comprised of pigment particles having a substantially continuous polymer coating on the surfaces thereof, the core particles being dispersed in a binder resin which does not substantially dissolve or melt the polymer coating.

The present invention also provides a process for the production of electrophotographic toner particles which process comprises encapsulating a selected pigment in a suitable polymer by dispersing particles of the pigment in a solution capable of depositing the polymer as a substantially continuous coating on the surfaces of the pigment particles to provide discrete encapsulated pigment particles. The resulting encapsulated pigment particles are then uniformly dispersed in a binder resin which does not substantially dissolve or melt the polymer coating and under conditions which permit the polymer coating to remain intact. Subsequently, the resulting dispersion is formed into toner particles of a predetermined size, preferably by solidifying the binder resin containing the dispersed encapsulated pigment particles and pulverizing the solid dispersion into toner particles of a predetermined size.

DESCRIPTION OF PREFERRED EMBODIMENTS OF THE INVENTION

In preparing the electrophotographic toner of the present invention, any organic or inorganic pigments for example, colloidal particles having average diameters less than about 0.9 microns, preferably of from about 0.005 to about 0.7 microns, or other particles having larger particle sizes up to about 10 microns can be used. Preferably, pigments having a particle size within the range of from about 0.05 to 1.5 microns and an average size of about 0.5 microns are employed. The pigments should be substantially insoluble and in the resins and solvents employed in encapsulating the pigment particles, e.g., water and hydrocarbons. Examples of useful inorganic pigments are carbon black, titanium dioxide, zinc oxide, antimony oxide, magnesium oxide, fly ash, red oxide, yellow oxide, lemon chrome and cobalt blue. Examples of suitable organic pigments include the rhodamines, the phthalocyanines, the azo lakes and other pigments used in formulating electrographic toners.

Many inorganic and organic pigments are well known for use in toners and, in general, any pigment providing the desired color may be used as long as the pigment particles are not adversely affected by the resins and solvents to be employed during encapsulation of the pigment particles.

To produce a toner of the desired color a suitable pigment is selected for encapsulation in a selected polymer. Various techniques for the encapsulation of pigment particles in polymeric materials are well known and any of these techniques may be used, provided that the encapsulation technique results in coating the entire surfaces of the pigment particles and discrete core particles, in essentially nonagglomerated form, of the pigment particles having a continuous polymer coating are formed, so as to electrically passivate the pigment particles. The thickness of the polymer coating on the pigment particles should be great enough to effect the electrical passivation of the particles. Depending upon the coating polymer, the useful range of coating thicknesses is from about 30 to about 400 Å. For resins normally used in the manufacture of toners, a coating thickness of about 200 Å provides adequate electrical passivation, since this is the electron tunnelling distance in such resins.

As used herein, the terms "passivation" and "electrical passivation" refers to electrically insulating the pigment particles from their surrounding environment to such a degree that various colored pigments having various intrinsic triboelectric charging levels can all be made to have triboelectric charging levels which are the same, or substantially the same, so as to enable different colored toners to be formulated using the same toner formulation except for pigment color.

The polymers that are useful for encapsulating the pigment particles should have a high mechanical strength so that the polymer coating does not become cracked or broken off the surfaces of the pigment particles during processing into the final toner. The preferred polymer for encapsulating the pigment particles is styrene/n-butyl methacrylate having a 58/42 weight ratio which has been cross-linked with divinyl benzene. Other suitable encapsulation polymers include polyesters, styrene-butadiene, styrene acrylate, other styrene-methacrylates and mixtures of the above. Monomers for forming these and other useful polymers are described hereinbelow.

The weight ratio of the pigment to the encapsulating polymer preferably is in the range of from 20/80 to 80/20, and a 50/50 weight ratio of pigment to polymer has been found to be especially satisfactory.

An especially preferred encapsulation technique is emulsion polymerization, which comprises the steps of (1) emulsifying a hydrophobic, emulsion polymerizable monomer in an aqueous colloidal dispersion of discrete particles of essentially water-insoluble pigment particles and (2) subjecting the resulting emulsion to emulsion polymerization conditions to form a stable, fluid aqueous dispersion of the pigment particles dispersed in a matrix of a water-insoluble polymer comprising the hydrophobic monomer.

The above hydrophobic monomers employed in the emulsion polymerization are essentially water-immiscible, e.g., the monomer forms a separate phase when 5 grams of monomer is mixed with 100 grams of water. Such water-immiscible monomer(s) should polymerize under emulsion polymerization conditions to form a water-insoluble polymer which will exist in the form of a stable aqueous dispersion, usually with the aid of suitable surface active agents. Examples of suitable hydrophobic monomers include monovinylidene aromatic monomers such as styrene, vinyl toluene, t-butyl styrene, chlorostyrene, vinylbenzyl chloride and vinylpyridine; alkyl esters of $\alpha$, $\beta$-ethylenically unsaturated acids such ethylacrylate, methylmethacrylate, butylacrylate and 2-ethylhexylacrylate; unsaturated esters of saturated carboxylic acids such as vinylacetate, unsaturated halides such as vinylchloride and vinylidene chloride; unsaturated nitriles such as acrylonitrile, dienes such butadiene and isoprene; and the like. Of these monomers, the monovinylidene aromatic such as styrene and the akylacrylates such butylacrylate are preferred.

In addition to the aforementioned hydrophobic monomer, relatively minor proportions, e.g. less than 10, preferably less than 5, weight percent based on total monomer component, of a water-soluble monomer such as an ethylenically unsaturated carboxylic acid or its salt such acrylic acid or sodium acrylate; methacrylic acid; itaconic acid and maleic acid; and ethylenically unsaturated carboxamide such as acrylamide, vinyl pyrrolidone; hydroxyalkyl acrylates and methacrylates such as hydroxyethyl acrylate, hydroxypropyl acrylate and hydroxyethyl methacrylate; amino akyl esters of unsaturated acids such as 2-aminoethyl methacrylate; epoxy functional monomers such as glycidyl methacrylate; sulfoakyl esters of unsaturated acids such 2-sulfoethyl methacrylate; ethylenically unsaturated quaternary ammonium compounds such as vinylbenzene trimethyl ammonium chloride may be employed. It is critical however, that such water-soluble monomers not be employed in amounts sufficient to render the resulting polymer soluble in water.

Particularly effective monomer recipes for the practice of this invention are those containing from about 20 to about 90 weight percent of styrene, from about 10 to about 80 weight percent of alkylacrylate such as butylacrylate and from about 0.01 to about 2 weight percent of the unsaturated carboxylic acids, such as acrylic acid, with the weight percentages being based on the weight of total monomers.

In the emulsion polymerization step, it is preferred to initially prepare an aqueous colloidal dispersion of the pigment particles by contacting such particles with an aqueous solution of a water-soluble surfactant or emulsifier, thereby forming the dispersion which contains from about 5 to about 70 weight percent of the pigment particles. Suitable surface active agents or emulsifiers include salts of fatty acids such as potassium oleate, metal akylsulfates such as sodium laurylsulfate, salts of akylaryl sulfonic acid such as sodium dodecylbenzene sulfonate, polysoaps such sodium polyacrylate and alkali metal salts of methylmethacrylate/2-sulfoethyl methacrylate copolymers and other sulfoakyl acrylate copolymers, and other anionic surfactants such as the dihexyl ester of sodium sulfosuccinic acid; non-ionic surfactants such as the non-ionic condensates of ethylene oxide with propylene oxide, ethylene glycol and/or propylene glycol; and cationic surfactants such as alkylamineguanidine polyoxyethanols, as well as a wide variety of micelle generating substances which are well known. Such surface active agents or emulsifiers are employed in amounts sufficient to provide a stable dispersion of the pigment particles in water.

The aqueous dispersion of pigment particles is then combined with the water-immiscible monomer to form the desired emulsion by normal mixing procedures, for example, passing both the dispersion and monomer through a high shear mixing device such as a Waring blender, homogenizer or ultrasonic mixer. Preferably, the monomer is added continuously to the aqueous dispersion of pigment during the polymerization. The aqueous emulsion of the monomer is maintained by a water-soluble monomer and/or a water-soluble emulsifier such as described above. Alternatively, the aqueous emulsion of the pigment particles and the water-immiscible monomer can be prepared by adding the pigment particles to an existing aqueous emulsion of the monomer. The water-immiscible monomer is present in a proportion sufficient to enclose or encapsulate the pigment particles when polymerized. Preferably, the emulsion contains from about 0.1 to about 25 weight percent of the pigment, from about 1 to about 30 weight percent of monomer and a remaining amount of the aqueous phase including emulsifier (surfactant), catalyst and the like.

The emulsion polymerization conditions are generally conventional free-radical type polymerizations carried out in the presence of a radical initiator such as a peroxygen compound, an azo catalyst, ultraviolet light and the like. Preferably, such polymerization is carried out in the presence of a water-soluble peroxygen compound at temperatures in the range of about 50° to about 90° C. The emulsion is generally agitated during the polymerization period in order to maintain adequate feed transfer. Examples of suitable catalysts include inorganic persulfate compounds, peroxides, azo catalysts and other common free-radical generating compounds.

Such emulsion polymerization process is described in more detail in U.S. Pat. Nos. 4,680,200 and 4,421,660, both of which are incorporated herein by reference and form a part hereof.

Following the emulsion polymerization, the discrete core particles can be separated from the aqueous continuous phase of the dispersion by conventional means and can be subjected to treatment such as drying under vacuum or spray drying, if desired. The dried encapsulated pigment particles preferably contain from about 20 to about 80 weight percent of pigment and from about 80 to about 20 weight percent of the polymer matrix.

The pigment particles can also be encapsulated by coating them with a vinyl pyrrolidone polymer layer by precipitating polymer from an aqueous solution with another solute, i.e., by salting out. In such process, organic pigment particles in a finely divided state are slurried in an aqueous solution of polymer and the polymer is precipitated onto the surface of discrete particles to encapsulate the pigment with a layer of at least 10 Å units thickness. The encapsulated pigment is separated from the aqueous mixture and may be recovered as a dried toner powder.

The vinyl pyrrolidone polymers and the "salting out" process are disclosed in greater detail in U.S. Pat. No. 3,904,562, which is incorporated herein by reference and forms a part hereof.

Upon completion of the encapsulation step, the encapsulated pigment particles, or discrete core particles, are separated from the solution in which the polymerization is effected. This may be accomplished by filtering or centrifuging, followed by washing the encapsulated pigment particles with a suitable liquid, such as acetone, to leave a wet presscake of encapsulated pigment.

The resulting encapsulated pigment particles with the polymer coating remaining intact are then uniformly dispersed in a binder resin without cracking or breaking of the polymer shell covering the pigment particles. Various known techniques such as solvent transfer, fluid bed drying or the like may be employed to prevent agglomeration of the encapsulated pigment particles so that they may be homogeneously dispersed, e.g., by melt-mixing in a binder resin. However, the preferred technique for dispersing the encapsulated pigment particles in the binder resin is a "flushing" procedure, which has been found to cause minimum damage to the polymer coating on the pigment particles so that the pigment particles remain electrically passivated and the triboelectric characteristics of the pigment particles do not have a substantial effect upon the toner particles of the present invention.

Many pigments and/or polymer coated particles are hydrophobic, in that they are more readily wetted by organic solvents than by water. When an aqueous presscake of these particles is mixed with an organic liquid or vehicle such as a synthetic resin/organic solvent mix, the particles transfer spontaneously to the organic phase, leaving the aqueous phase free of the particles. This is referred to herein as "flushing". The greater part of the water can be removed by pouring it off, and the remaining portion of the water can be driven off by heat or vacuum drying, either as a separate step or incidentally during further processing. The flushing procedure itself disperses the particle in the organic medium to a considerable extent, and the development of a complete dispersion may be accomplished with relatively little further mixing, for example in a sigma blade mixer.

One suitable flushing procedure is described in U.S. Pat. No. 4,794,066, which is incorporated herein by reference and forms a part hereof. In this flushing procedure a water-wet presscake of encapsulated pigment is intimately mixed with at least one water-insoluble vehicle in the absence of a solvent for the water-insoluble vehicle until water separates from the mixture leaving the pigment dispersed in the water-insoluble vehicle. Then, substantially all of the water is removed, following which the pigment dispersion is further dispersed at an elevated temperature in a vessel under high shear in a thermoplastic resin, the temperature being maintained to plasticize and liquefy the resin. Subsequently, the resulting dispersion is cooled, solidified and formed into toner particles. In the foregoing flushing procedure useful thermoplastic resins include ethylene vinyl acetate, copolymers of ethylene and an $\alpha$, $\beta$-ethylenically unsaturated acid selected from the class consisting of acrylic acid and methacrylic acid, copolymers of ethylene/acrylic or methacrylic acid/alkylester of methacrylic or acrylic acid, polyethylene, polystyrene, isotatic polypropylene, ethylene ethylacrylic series resins, ethylene vinyl acetate resins and the like. Water-insoluble liquids useful in the foregoing flushing procedure include branched-chain aliphatic hydrocarbons and other nonpolar liquids having a satisfactory electrical volume resistivity and dielectric constant.

Another suitable flushing technique which produces an excellent dispersion of the pigment particles in a binder resin is disclosed in U.S. Pat. No. 3,904,562, which is incorporated herein by reference and forms a part hereof. In this latter flushing process the encapsulated pigment particles are transferred from an aqueous dispersion or a wet presscake to an organic hydrophobic vehicle by mixing the aqueous pigment dispersion in a suitable vessel. This finishing step should be carried out without excessive shear or attrition to avoid breaking the polymer shell coating the pigment particles. When the aqueous presscake or slurry of the encapsulated pigment particles is mixed with an organic liquid or soft resin vehicle, such as a synthetic binder resin, flushing occurs and the pigment particles are transferred from the aqueous phase to the organic phase spontaneously by nature of their physical and chemical properties.

While various known polymers may be employed for use as the binder resin, the preferred binder resins include polyesters, styrene-butadiene, styrene acrylate, styrene methacrylate resins and mixtures thereof.

The flushing process typically includes the steps of loading the selected binder resin and solvents in a flusher. The flusher may be a Sigma blade mixer equipped with heat transfer jacket and high power to volume ratio. Normally 2–4 HP/gallon is required for mixing toner type resins with solvent and aqueous presscake. The mixing bowl is set up on pivots so that the water can be decanted during the procedure. Normal loading for resin/presscake flushing is $\frac{2}{3}$ of the volume capacity of the bowl. The aqueous presscake is typically particles of the encapsulated pigment dispersed in an aqueous phase, usually containing 50/70 percent water. The solvent employed during the flushing procedure is an organic type solvent, such as toluene, xylenes, methyl ethyl ketone (MEK), chlorinated hydrocarbons or the like.

After the resin and solvent are loaded in the flusher, mixing is started while the temperature is brought up to the operating level. For toner resins this is usually around 60° C. Fifty percent of the presscake is added to the resin/solvent mixture and mixing continues until the first "break" occurs. The "break" is the time during the mixing at which the water will "pool out" or separate from the organic phase. When the first break occurs, the water is decanted, and another 25 percent of the presscake is added and the mixing continued until the second break occurs, when the water is decanted again. Finally, the remaining 25 percent of the presscake is added and mixing continued until the final break occurs. The final water is decanted and mixing is continued for the working period, i.e., the period of time after the water pools out and the mixing is continued in the Sigma mixer until the dispersion is completed. Following the flushing, the entrapped water and solvents are dried from the resin/encapsulated pigment particle mix. This can be done in the Sigma blade mixer under heat and vacuum or in a separate piece of equipment if desired. In place of the Sigma blade mixer referred to above, the mixing of the encapsulated pigment particles can be accomplished via other types of equipment, such as Banbury-roll mills, extruders and the like.

In preparing the dispersion of the encapsulated pigment particles in the binder resin, the amount of encapsulated pigment in the binder resin is from about 0.5 to about 50% by weight of the dispersion, depending upon the desired intensity of toner color and the like.

Following the dispersion of the encapsulated pigment particles in the binder resin, the dispersion is cooled to the desired temperature to solidify the binder resin, which is then pulverized to form the final toner particles. The pulverization may be accomplished by known methods utilizing, for example, fluid energy mills and, if desired, classification can be accomplished with, for example, sieves, air classification or other known means to enable toner particles having a known diameter of from about 10 to about 25 microns, as measured by Coulter counter equipment, to be formed.

If, desired, any of various known toner additives may be included in the formulation for making toners according to the present invention for the purposes of improving flowability, adjusting the physical properties of the binder resin and like purposes. Also, a charge control addition may be included to adjust the triboelectric characteristics of toners of different colors to a level required to permit their use in a given xerographic machine requiring that level.

To demonstrate the beneficial effects of the toner of the present invention relative to toners which have not been passivated electrically, e.g., toner particles not having a continuous coating of polymer covering all the surfaces of the toner particles, the tests described hereinbelow were performed.

Three pigments from American Hoechst Company, Hostaperm Pink, Novoperm Yellow and PV Fast Blue were treated by encapsulation with a cross-linked polymer. The polymer was a 58/42 weight percent styrene/n-butyl methacrylate cross-linked with divinyl benzene. The encapsulation method disclosed in U.S. Pat. No. 4,680,200 was used. The resulting encapsulated pigment to polymer weight ratio was 1/1. The so-treated pigment particles were melt-mixed in a BR Farrel Banbury melt mixer with a styrene/n-butyl methacrylate (58/42 weight ratio) copolymer using a 10/90 weight percent ratio of encapsulated pigment to binder resin. After the melt mixing, the dispersion of the encapsulated pigment in the binder resin was cooled, and this was followed by mechanically attriting the dispersion in a Model 0202 Jet-0-Miser fluid energy mill. The resulting particles were then classified using a Donaldson Model B classifier and toner particles having particle sizes in the range of 2 to 20 microns and an average particle size of 11 microns were recovered.

Control toners were also prepared using the same three untreated pigments dispersed in the above-described binder resin at a ratio of 5 weight percent non-coated pigment to 95 weight percent binder resin. The control toners were prepared as described above by melt mixing the untreated pigment into the matrix resin using a Banbury-roll mill.

The following Examples show that above-described treatment of the pigments by encapsulation with the cross-linked polymer greatly narrow the differences in triboelectric characteristics, or tribos, of the toners made with the treated pigments as compared to the control toners made with untreated pigments.

To measure the tribos of the colored toners, each of the toners described above was mixed with the indicated steel carrier (100/2.5 carrier to toner ratio by weight) and the mixture was put into a four ounce jar and placed on a roll mill. The mix was rolled for thirty minutes and the tribo of each toner was measured (as microcoulombs per gram) using a known Faraday Cage apparatus.

EXAMPLE 1

Tribos of the colored toners were measured against bare steel carrier.

| | treated pigment | untreated pigment |
|---|---|---|
| Hostaperm Pink toner | 17 | 4 |
| PV Fast Blue toner | 15 | 3 |
| Novoperm Yellow toner | 22 | 24 |
| range | 7 | 20 |

EXAMPLE 2

Tribos of the colored toners were measured against steel core coated with chloro-fluro-polymer.

| | treated pigment | untreated pigment |
|---|---|---|
| Hostaperm Pink toner | 21 | 27 |
| PV Fast Blue toner | 24 | 35 |
| Novoperm Yellow toner | 20 | 22 |

-continued

| | treated pigment | untreated pigment |
|---|---|---|
| range | 4 | 13 |

EXAMPLE 3

Tribos of the colored toners were measured against steel core coated with methacrylate terpolymer.

| | treated pigment | untreated pigment |
|---|---|---|
| Hostaperm Pink toner | 4 | 5 |
| PV Fast Blue toner | 5 | 6 |
| Novoperm Yellow toner | 10 | 21 |
| range | 6 | 16 |

The foregoing data demonstrate that regardless of the pigment used, toners can be made in accordance with present invention that will have tribos that fall in a very narrow range as compared to the tribo range of a similar toner made with a pigment which was not encapsulated in accordance with the present invention.

Having described preferred embodiments of the present invention, it is to be recognized that variations and modifications thereof falling within the spirit of the invention may become apparent to those skilled in this art, and the scope of the present invention is to be determined by the appended claims and their equivalents.

What is claimed is:

1. An electrophotographic toner comprising toner particles formed of a dispersion of discrete core particles in a toner resin, said core particles each comprising a discrete encapsulated pigment particle within a substantially continuous polymer coating formed on the surfaces thereof, wherein said toner resin does not substantially dissolve or melt said polymer coating so that said polymer coating provides electrical passivation of said discrete particles.

2. The toner of claim 1, wherein said polymer coating comprises a polymer selected from the group consisting of polyester, styrene-butadiene, styrene-acrylate, and styrene-methacrylate resins and mixtures thereof.

3. The toner of claim 2, wherein said polymer coating is a styrene/n-butyl methacrylate copolymer cross-linked with divinyl benzene.

4. The toner of claim 1, wherein said discrete core particles comprise from about 20 to about 80 weight percent of said pigment and from about 80 to about 20 weight percent of said polymer coating.

5. The toner of claim 1, wherein said polymer coating has a thickness of from about 30 to about 400 Angstroms.

6. The toner of claim 1, wherein said toner resin comprises a resin selected from the group consisting essentially of polyester, styrene-butadiene, styrene-acrylate, and styrene-methacrylate resins and mixtures thereof.

7. The toner of claim 1, wherein said toner comprises from about 0.5 to about 50 weight percent of said core particles.

8. The toner of claim 1, wherein said polymer coating is a styrene/n-butyl methacrylate copolymer cross-linked with divinyl benzene, the weight ratio of said pigment particles to said coating polymer is from about 20/80 to about 80/20, said toner resin is a styrene/n-butyl methacrylate copolymer, and the weight ratio of said core particles to said toner resins is from about 0.5/99.5 to about 50/50.

9. The toner of claim 1, wherein said dispersion is a solid dispersion and said toner particles are formed by pulverizing said solid dispersion.

* * * * *